United States Patent [19]

Donaldson

[11] 4,320,701

[45] Mar. 23, 1982

[54] COMPOSITE BALE TIE METHOD

[76] Inventor: Harris M. Donaldson, 463 Los Pajaros Ct., Los Altos, Calif. 94022

[21] Appl. No.: 131,948

[22] Filed: Mar. 21, 1980

[51] Int. Cl.[3] ..... B65B 13/02

[52] U.S. Cl. ..... 100/3; 24/27; 206/83.5

[58] Field of Search ..... 100/3, 8, 11, 29, 32, 100/33 R; 206/83.5; 24/27, 16, 28, 17 A, 29, 20 EE, 23 EE; 140/73, 93 A; D2/380, 387, 390; 2/311, 317, 318, 319; 63/1 A, 3, 6

[56] References Cited

U.S. PATENT DOCUMENTS

| | | | |
|---|---|---|---|
| 205,918 | 7/1878 | Smith | 24/27 |
| 304,308 | 9/1884 | Frank | 217/68 |
| 322,442 | 7/1885 | Griswold | 24/27 |
| 505,580 | 9/1893 | Watson | 100/3 |
| 885,917 | 4/1908 | Ferris | 24/27 |
| 925,484 | 6/1909 | Knoble | 24/27 |
| 1,261,036 | 4/1918 | Kerns | 24/27 |
| 1,437,440 | 12/1922 | Pentecost | D2/380 X |
| 4,156,385 | 5/1979 | Lems et al. | 100/3 |

FOREIGN PATENT DOCUMENTS

| | | | |
|---|---|---|---|
| 394034 | 11/1965 | Switzerland | 100/3 |

*Primary Examiner*—Billy J. Wilhite
*Attorney, Agent, or Firm*—Naylor, Neal & Uilkema

[57] ABSTRACT

A two piece bale tie is provided to enable the tie, when the pieces are connected together, to be used on a large bale and to enable one of the pieces to be used as a tie on a smaller bale when the pieces have been disconnected.

1 Claim, 7 Drawing Figures

COMPOSITE BALE TIE METHOD

BACKGROUND OF THE INVENTION

In the baling of cotton in the United States it is common practice to press the bales at the gin site to a density of 12–20 lbs. per cu. ft. Bales pressed to this density are known as "flat bales". They are fitted with 10'3" steel bale ties. Because of the bulk of these "flat bales" and their consequent high transportation cost, the bales are shipped from the gin site to a centralized storage and recompression installation, the "cotton compress", where the bales are recompressed to a smaller size and a density of about 30 lbs. per cu. ft. The smaller bales are known as U.D. (Universal Density) bales. They are fitted with 6'10" steel bale ties.

The practice in the past was to use steel band ties for cotton baling at both the gin and the compress. At the compress the band ties were removed from the flat bales, flattened out, cut to a shorter length, 7'6", and reused on the compress bales along with the buckles which were part of the original ties. Frequently cutoff sections were spliced together to form the new shorter ties for the compress bales.

Hot rolled steel band and buckle combinations for the baling of cotton are no longer produced in sufficient quantity to supply the demand. Many of the gins and the compresses are converting over to the use of steel wire bale ties. One end of a wire tie, for example, is formed into a hook-like fastener and the other end is formed into a loop-like fastener. The two ends are attached together to secure the tie around the bale.

The conversion from steel bands to wire bands has led to a search for ways and means for efficiently salvaging at a low cost the flat bale wire ties for use on U.D. bales. A recent development along these lines has been the provision of machines which straighten and cut the flat bale wire ties to the U.D. bale tie length requirement and which then, in a separate operation, form each end of the 6'10" tie into locking configurations. Such reworking of the ties is a slow operation in the overall sense due primarily to manual handling and feeding of these machines. This procedure also results in the loss to scrap of the 3'5" length of the original tie which is cut off to adapt the remaining 6'10" section for conversion in the U.D. bale tie.

SUMMARY OF THE INVENTION

The present invention constitutes a solution of the above mentioned problem of reclaiming wire bale ties for re-use. I do this without producing any scrap material by providing two ties of different length each provided with the hook and loop type of fastening elements at their ends. The two ties are connected together to form a tie for a flat bale. This composite wire bale tie is removed at the compress and the longer one of the two tie pieces is applied to the recompressed U.D. bale. The long tie piece has a length of 6'10" and the short tie piece has a length of 3'5". The U.D. bale ties become lost in commerce. The shorter, or splice, ties are returned to the gin sites for reconnection to 6'10" tie pieces and re-use. The net result is that the gins buy 6'10" ties but use 10'3" ties due to continuous re-use of the shorter, or splice, ties.

The essential object and advantage of the invention is to provide a way and means to use flat bale tie material on U.D. bales and eliminate the production of scrap tie material as this is accomplished.

DESCRIPTION OF THE PREFERRED EMBODIMENTS

Figure 1:
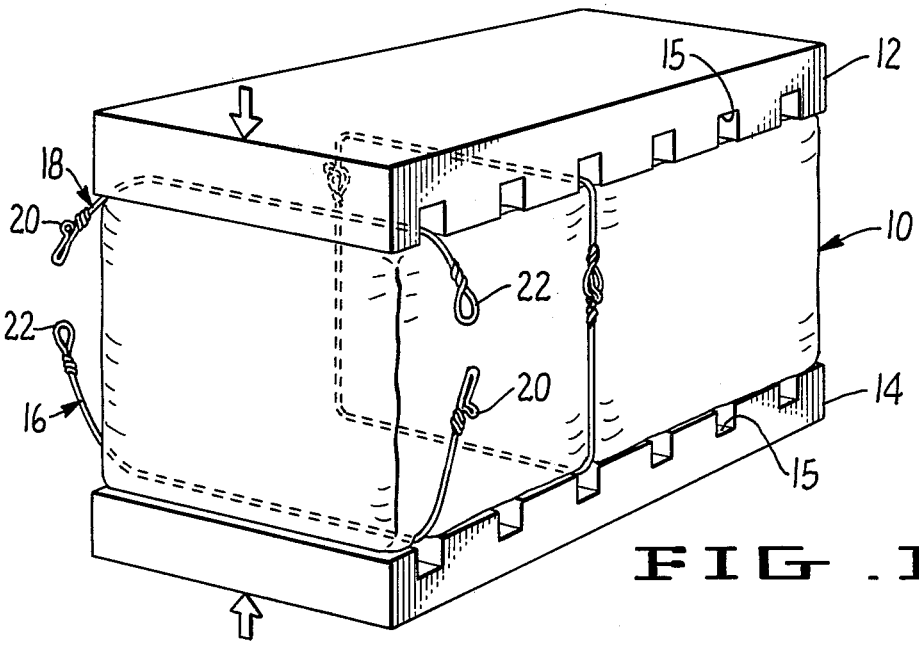
FIG. 1 is a view in perspective of a gin site baling press and bale, the composite tie of the invention being shown in solid outline in disconnected condition and in dotted outline in connected condition.
Figure 2:
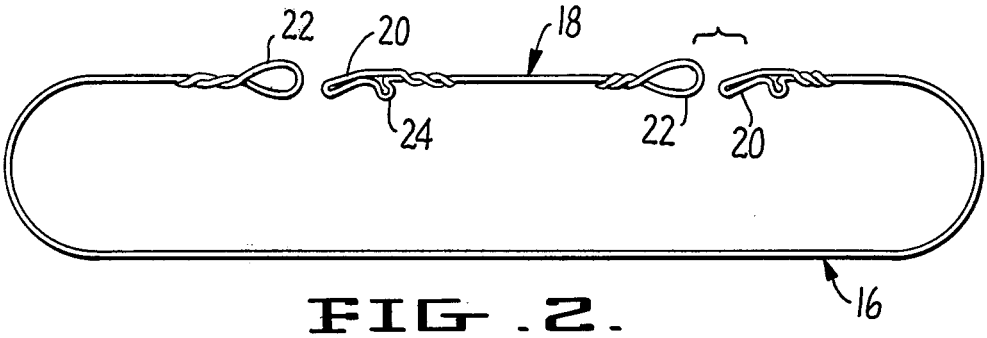
FIG. 2 is a plan view of the composite tie of the invention, the components being shown in end to end disconnected relation to each other.

A flat bale 10 is shown in FIG. 1 as being disposed between the upper and lower platens 12, 14 of a gin site baling press. The slots 15 are provided to accommodate bale ties and enable the ties to be passed around the bale and tied off before release of the platen pressure. The composite tie of the invention is comprised of a relatively long tie 16 having a length of approximately 6'10" and a splice tie 18 having a length of approximately 3'5". Each tie is provided at one end with a crosshead 20 and at the other end with a loop 22. A crosshead and loop tie of this type is shown in U.S. Pat. No. 885,917 which issued on Apr. 28, 1908 to W. D. Ferris. The crossheads are connected to the loops by inserting them through the loops and positioning the strand of the loop behind the hook portion 24 of the crosshead, as shown in FIG. 1. A number of ties, six or so, are placed about the bale.

The best location for the splice 18 is that it be located in the upper platen slots in the press with the ends of the splice protruding outwardly approximately 6–12" from the platen. This enables the press men to hand-connect the two sets of ends of the ties 16 and 18 together so that the final position of the interconnected tie ends are on the front and back faces of the bale about 6–12" below the upper front and the upper back edge of the bale. It is preferable that the two ties 16 and 18 be initially disposed in the platen slots in disconnected relation to each other, as in FIG. 1. If the two ties are first connected together at one end and then threaded through the platen slots, they might become unhooked during the slot-threading operation. It is also preferable to first connect the ends of the two ties at the back side of the press, thereby enabling the slack to be pulled out of the ties as they are pulled forwardly around the bale to effect connection of the ends 20, 22 at the front side of the press.

After the flat bale 10 has been finished at the gin site it is transported to the cotton compress where it is recompressed.

The flat bale ties are customarily removed from the bale prior to recompression of the bale to U.D. size. The bale is lightly pressed in what is called a "Dinkey Press" to create slack in the ties so that they can be removed from the bale. The ties 16 and 18 are opened at one pair of ends and removed together from the bale. The splice tie 18 is then disengaged from the long, or U.D. bale, tie 16. The splice ties are stored for return to the cotton gin for re-use in combination with new U.D. length bale ties. This results in a substantial saving to the cotton gins as they need purchase only the shorter length U.D. bale ties for combination with the re-use splice ties to make up the flat bale ties.

After being disconnected from the splice ties, the U.D. bale ties 16 may require some straightening at this point for optimum handling in the tying of the U.D. bales. The loops 22, if they have been stretched and thereby narrowed too much to maintain a high level of installation speed and efficiency in the tying of the U.D. bale, may be reformed to their original shape by a simple die and punch operation in which the punch is inserted in the loop which has been placed in the die and then struck with a hammer to spread and shape the loop to the original configuration. The U.D. tie 16 is then ready for use by the cotton compress crew.

The only limitations on the continued re-use of the splice ties are metal fatigue causing failure of the tie or its locking ends, abuse during handling which might damage the wire and cause breakage, and disfigurement of the locking configuration of the tie ends through stress or abuse to the point that reforming them to the original shape is no longer feasible.

The economies to the cotton compresses arising out of the use of the subject composite tie are also substantial inasmuch as there is no need for a compress to purchase a second set of ties for U.D. bales. No special re-working equipment other than the simple equipment above described is required. The labor costs of re-working original flat bale ties is reduced and there is no scrap loss or scrap disposal cost to contend with.

Figure 3:
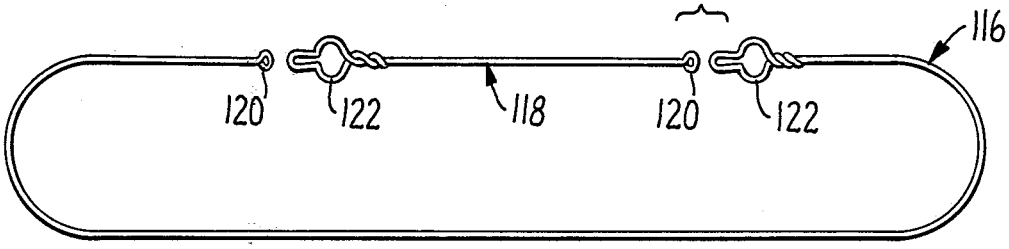
FIG. 3 is a view similar to that of FIG. 2 but showing a specifically different tie and locking configuration.

In the embodiment of FIG. 3, the U.D. and splice ties 116, 118 are provided at their ends with complemental fastening means comprising heads 120 and keyhole loops 122.

Figure 4:
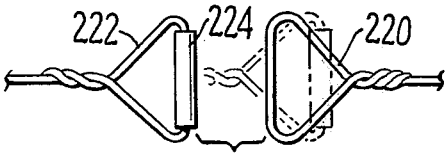
FIG. 4–FIG. 7 are enlarged plan views of other tie and locking configurations which may be used in the composite tie of the invention.

In the embodiment of FIG. 4, the complemental fastening means are interlocking loops 220, 222, one of which is provided with a reinforcement member 224.

Figure 5:
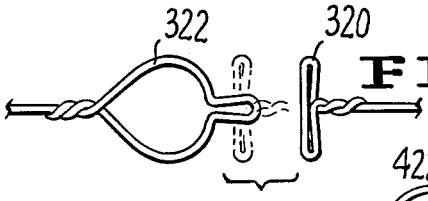

In the embodiment of FIG. 5, the complemental fastening means comprises collapsed loop 320 and keyhole loop 322.

Figure 6:
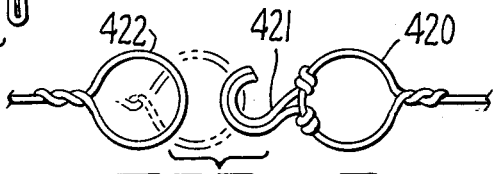

In the embodiment of FIG. 6, the complemental fastening means comprises loop 420 which carries a hardened hook 421 and loop 422.

Figure 7:
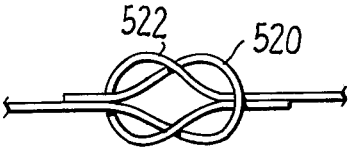

In the embodiment of FIG. 7, the complemental fastening means comprises loop elements 520, 522 which together form a square knot connection.

What is claimed is:

1. In the method of handling cotton and wool and the like which comprises the steps of tying a large bale at a gin with a plurality of long wire ties having at their ends complemental fastening means, untying the bale at a compress, compressing the bale to a smaller size, and tying the smaller bale with a plurality of short wire ties having at their ends complemental fastening means, the improvement comprising the steps of making up said long ties by connecting together first and second ties having at their ends complemental fastening means, said first tie corresponding in length to one of said short ties and said second tie having a length corresponding to the circumferential difference between said large bale and said smaller bale, disconnecting the first and second ties at the compress and maintaining them intact for further use, connecting the first tie about one of said smaller bales, and returning the second tie to the gin for re-use in the make-up of said long ties.

* * * * *